US009478164B2

(12) United States Patent
Ma

(10) Patent No.: US 9,478,164 B2
(45) Date of Patent: Oct. 25, 2016

(54) COMPENSATION PIXEL CIRCUIT AND DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/443,511

(22) PCT Filed: Sep. 30, 2014

(86) PCT No.: PCT/CN2014/087897

§ 371 (c)(1),
(2) Date: May 18, 2015

(87) PCT Pub. No.: WO2015/169043

PCT Pub. Date: Nov. 12, 2015

(65) Prior Publication Data

US 2015/0348462 A1 Dec. 3, 2015

(30) Foreign Application Priority Data

May 8, 2014 (CN) ..... 2014 1 0194265

(51) Int. Cl.
*G09G 3/3225* (2016.01)
*G09G 3/3233* (2016.01)
*G09G 3/32* (2016.01)

(52) U.S. Cl.
CPC ..... *G09G 3/3225* (2013.01); *G09G 3/3233* (2013.01); *G09G 2230/00* (2013.01); *G09G2300/0819* (2013.01); *G09G 2300/0842* (2013.01); *G09G 2300/0861* (2013.01); *G09G 2310/061* (2013.01); *G09G 2320/0233* (2013.01); *G09G 2320/045* (2013.01)

(58) Field of Classification Search
CPC ..... G09G 3/3233; G09G 3/3291; G09G 3/3258; G09G 3/3208; G09G 3/325; G09G 3/3659; G09G 3/3677; G09G 3/3688; G09G 3/2014; G09G 3/32; G09G 3/3696; G09G 3/3216; G09G 3/22; G09G 3/2025; G09G 3/342; G09G 3/3614; G09G 3/2077; G09G 3/3406; G09G 3/3426; G09G 3/2085; G09G 2300/0819; G09G 2300/0842; G09G 2300/0852; G09G 2300/0861; G09G 2300/0866; G09G 2300/0426; G09G 2300/08; G09G 2300/088; G09G 2300/0847; G09G 2300/0443; G09G 2300/0823; G09G 2310/0251; G09G 2310/0262; G09G 2310/0256; G09G 2310/06; G09G 2310/10; G09G 2310/04; G09G 2310/061; G09G 2310/0248; G09G 2310/0254; G09G 2310/08; G09G 2310/0205; G09G 2310/066; G09G 2310/063; G09G 2310/0272; G09G 2310/062; G09G 2310/0221; G09G 2310/0224; G09G 2310/0267; G09G 2310/0291; G09G 2320/043; G09G 2320/0233; G09G 2320/045; G09G 2320/0223; G09G 2320/0626; G09G 2320/0252; G09G 2320/029; G09G 2320/02; G09G 2320/0693; G09G 2320/0261; G09G 2320/0204; G09G 2320/0209; G09G 2320/0214; G09G 2320/0673; G09G 2320/0247; G09G 2320/0257; G09G 2320/066; G09G 2320/0266; G09G 2320/046; G09G 2330/04; G09G 2330/025; G09G 2340/16; G09G 2360/144; G09G 2360/145; G09G 5/10; H01L 27/124; H01L 27/3262; H01L 27/1214; H01L 27/3272; H01L 27/3276; H01L 27/1255; H01L 27/12; H01L 27/3265; H01L 27/3248; H01L 27/1251; H01L 27/3258; H01L 29/78696; H01L 29/66969; H01L 29/42384; H01L 29/66742; H01L 29/78645; H01L 29/41733; H01L 2227/323; H01L 2251/5338; H05B 33/0896
See application file for complete search history.

(56) References Cited

U.S. PATENT DOCUMENTS

| | | | |
|---|---|---|---|
| 2009/0140957 | A1 | 6/2009 | Park et al. |
| 2013/0088474 | A1 | 4/2013 | Wang et al. |

FOREIGN PATENT DOCUMENTS

| | | | | |
|---|---|---|---|---|
| CN | 202394497 | U | | 8/2012 |
| CN | 102693696 | A | | 9/2012 |
| CN | 102881253 | A | | 1/2013 |
| CN | 103035198 | A | | 4/2013 |
| CN | 103050080 | A | * | 4/2013 |
| CN | 103150991 | A | | 6/2013 |
| CN | 103236238 | A | | 8/2013 |
| CN | 203250518 | U | | 10/2013 |
| CN | 103985352 | A | | 8/2014 |
| CN | 203812537 | U | | 9/2014 |

OTHER PUBLICATIONS

English Language translation of CN 103050080 A; published Apr. 17, 2013.*
International Search Report of the International Searching Authority with Notice of Transmittal of the International Search Report of PCT/CN2014/087897 in Chinese, mailed Feb. 17, 2015.
Written Opinion of the International Searching Authority of PCT/CN2014/087897 in Chinese with English translation mailed Feb. 17, 2015.
First Chinese Office Action in Chinese Application No. 201410194265.X mailed Aug. 24, 2015 with English translation.
Second Chinese Office Action in Chinese Application No. 201410194265.X mailed Mar. 10, 2016 with English translation.

* cited by examiner

*Primary Examiner* — Nalini Mummalaneni
(74) *Attorney, Agent, or Firm* — Collard & Roe, P.C.

(57) ABSTRACT

There are provided a compensation pixel circuit and a display apparatus. The compensation pixel circuit comprises an organic light emitting diode (D1) and a driving transistor (M1), a first terminal of the driving transistor (M1) being connected to an anode of the organic light emitting diode (D1). The compensation pixel circuit further comprises: a resetting module, a data voltage writing module, a light emitting control module and a switching module. The resetting module includes a capacitor (C1) whose first terminal is connected to a gate of the driving transistor (M1) and configured to make the gate of the driving transistor (M1) discharge so that a gate voltage is reduced to a magnitude of a threshold voltage of the organic light emitting diode (D1). The data voltage writing module is configured to discharge at the gate of the driving transistor (M1) so as to connect a data voltage to a second terminal of the driving transistor (M1) after the gate voltage is made reduced to the magnitude of the threshold voltage of the organic light emitting diode (D). The light emitting control module is configured to connect a source of the driving transistor (M1) and a second terminal of the capacitor (C1) to an operating voltage at a high level after data voltage writing is completed. The switching module is configured to disconnect the driving transistor (M1) from the organic light emitting diode (D1) when the data voltage is connected to the second terminal of the driving transistor (M1). The compensation pixel circuit can compensate for the threshold voltage offset, and reduce the influence of signals from frame to frame greatly.

18 Claims, 2 Drawing Sheets

COMPENSATION PIXEL CIRCUIT AND DISPLAY APPARATUS

CROSS REFERENCE TO RELATED APPLICATIONS

This application is the National Stage of PCT/CN2014/087897 filed on Sep. 30, 2014, which claims priority under 35 U.S.C. §119 of Chinese Application No. 201410194265.X filed on May 8, 2014, the disclosure of which is incorporated by reference.

TECHNICAL FIELD

The present disclosure relates to a compensation pixel circuit and a display apparatus.

BACKGROUND

Active matrix organic light emitting diode (AMOLED) display is a display technique applied to a television and a mobile device, and has a broad application prospect in a power-sensitive portable electronic device due to its characteristics of lower power consumption, low cost and large size.

At present, in the AMOLED display field, in particular, in the large-size substrate design, a backplane thin film transistor (TFT) has problems of uniformity and stability in the technical process of production. On one hand, this would cause that a threshold voltage offset exists between different TFTs; on the other hand, stability of TFT is reduced after opening a bias voltage for a long time. These problems cause non-uniformity and instability of current for driving an OLED, thereby affecting the display effect.

In the prior art, there are many AMOLED compensation circuit designs performed by considering only the problem of the threshold voltage offset. However, these designs neglect the problem that the load of a gate signal line is raised gradually with the trend of the large size of AMOLED, which results in occurrence of voltage attenuation on the gate signal line, so as to affect current uniformity in the display area. These problems cause non-uniformity of light emitting of OLED, which reduces the display effect.

SUMMARY

In view of deficiencies of the prior art, the present disclosure provides a compensation pixel circuit and a display apparatus, which has not only the function of compensating for the threshold voltage offset but also the function of resetting a gate voltage of a driving transistor, thereby reducing greatly the influence of signals from frame to frame.

According to one aspect of the present disclosure, there is provided a compensation pixel circuit comprising an organic light emitting diode and a driving transistor, a first terminal of the driving transistor being connected to an anode of the organic light emitting diode, wherein the compensation pixel circuit further comprises: a resetting module including a capacitor whose first terminal is connected to a gate of the driving transistor and configured to make the gate of the driving transistor discharge so that a gate voltage is reduced to a threshold voltage of the organic light emitting diode; a data voltage writing module configured to discharge at the gate of the driving transistor so as to connect a data voltage to a second terminal of the driving transistor after the gate voltage reduced is made to the threshold voltage of the organic light emitting diode; a light emitting control module configured to connect a source of the driving transistor and a second terminal of the capacitor to an operating voltage at a high level after data voltage writing is completed; and a switching module configured to disconnect the driving transistor from the organic light emitting diode when the data voltage is connected to the second terminal of the driving transistor.

Alternatively, the resetting module further comprises a sixth switching element and a seventh switching element, wherein a first terminal and a second terminal of the sixth switching element are connected to the gate and the first terminal of the driving transistor respectively; a second terminal of the seventh switching element is connected to a predetermined voltage and a first terminal thereof is connected to the second terminal of the capacitor.

Alternatively, signals connected to control terminals of the sixth switching element and the seventh switching element are configured to control the sixth switching element and the seventh switching element to be in a turn-on state when the resetting module and the data voltage writing module operate and to be in a turn-off state when the light emitting control module operates.

Alternatively, the data voltage writing module comprises a third switching element, whose first terminal is connected to the second terminal of the driving transistor, and second terminal is connected to a data voltage line.

Alternatively, a signal connected to a control terminal of the third switching elements is configured to control the third switching element to be in the turn-on state when the data voltage writing module operates and to be in the turn-off state when the resetting module and the light emitting control module operate.

Alternatively, the light emitting control module comprises a fourth switching element and a fifth switching element, whose second terminals are connected to an operating voltage line at the high level; a first terminal of the fourth switching element is connected to the second terminal of the driving transistor; and the first terminal of the fifth switching element is connected to the second terminal of the capacitor.

Alternatively, signals connected to control terminals of the fourth switching element and the fifth switching element are configured to control the fourth switching element and the fifth switching element to be in the turn-off state when the resetting module and the data voltage writing module operate and to be in the turn-on state when the light emitting control module operates.

Alternatively, the switching module comprises a second switching element, whose first terminal is connected to the anode of the organic light emitting diode, and second terminal is connected to the first terminal of the driving transistor.

Alternatively, the driving transistor, the second to seventh switching elements are thin film transistors.

According to another aspect of the present disclosure, there is provided a display apparatus comprising any one of the compensation pixel circuits as described above.

The embodiments of the present disclosure has at least following beneficial effects:

The configuration of the compensation pixel circuit provided in the embodiments of the present disclosure makes that the current finally driving the OLED to emit light is unrelated to a threshold voltage Vth and a bias voltage $V_{DD}$, so that it can not only compensate the OLED current difference caused by the threshold voltage offset but also have the function of compensating the influence of the signal voltage attenuation on the current.

At the same time, since the resetting module in the circuit can reset the gate voltage of the driving transistor, it makes that an upper frame signal has litter impact on a lower frame signal, thereby reducing influence of signals from frame to frame greatly.

Of course, any product or method that implements the embodiments of the present disclosure does not necessarily require achieving all of the above advantages simultaneously.

DETAILED DESCRIPTION

In order to make the purpose, the technical solutions and the advantages of embodiments of the present disclosure more clear, embodiments of the present disclosure will be described clearly and completely by combining with the accompanying figures.

First Embodiment

Figure 1:
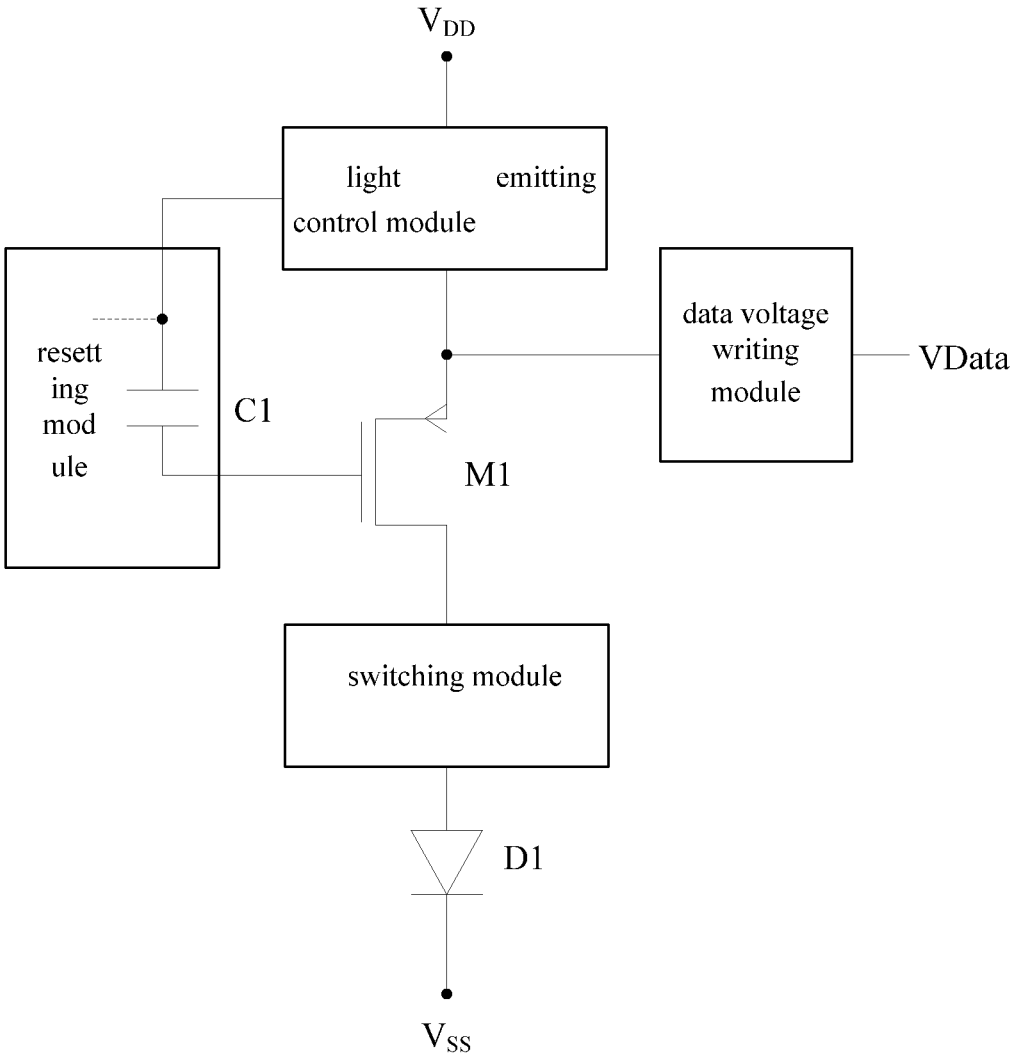
FIG. 1 is a schematic diagram of configuration of a compensation pixel circuit in an embodiment of the present disclosure.

FIG. 1 shows schematically configuration of a compensation pixel circuit of a first embodiment of the present disclosure. As shown in FIG. 1, the circuit comprises an organic light emitting diode D1 and a driving transistor M1. A first terminal of the driving transistor M1 is connected to an anode of the organic light emitting diode D1 via a switching module. The compensation pixel circuit further comprises:

a resetting module including a capacitor C1 whose first terminal is connected to a gate of the driving transistor M1 and configured to make the gate of the driving transistor M1 discharge so that a gate voltage is reduced to a magnitude of a threshold voltage of the organic light emitting diode D1;

a data voltage writing module configured to supply a data voltage VData to a second terminal of the driving transistor M1 after the gate of the driving transistor M1 discharges and the gate voltage is made reduced to the magnitude of the threshold voltage of the organic light emitting diode D1;

a light emitting control module configured to connect a source of the driving transistor M1 and a second terminal of the capacitor C1 to an operating voltage $V_{DD}$ at a high level after data voltage writing is completed (a corresponding operating voltage at a low level is $V_{SS}$ connected to a cathode of D1); and a switching module configured to disconnect the driving transistor M1 from the organic light emitting diode D1 when the data voltage is supplied to the second terminal of the driving transistor M1.

It is well known that a transistor has a gate, a source and a drain, but "the first terminal of the driving transistor M1" herein refers to a terminal connected to the anode of the organic light emitting diode D1. This terminal may be a source or a drain of the transistor depending on different types of selected transistors.

Since the resetting module is configured to make the gate of the driving transistor M1 discharge so that the gate voltage is reduced to magnitude of the threshold voltage of the organic light emitting diode D1, and it includes the capacitor C1 whose first terminal is connected to the gate of the driving transistor M1, this discharging process is completed apparently by the capacitor C1. Since it is evident that the anode of D1 has to be connected to one terminal of the capacitor C1, the gate terminal of M1, the second terminal of C1 and the anode of D1 have to be connected to one point in order to realize such function, i.e., connecting the second terminal of the capacitor C1 to a constant voltage having a higher voltage value compared with an operating voltage at a low level, so that a potential at the gate of the driving transistor M1 is discharged via D1, thereby finally making the potential at this point become the threshold voltage of D1. Thus, it is implied herein a connecting relationship of the gate of M1 being also connected to D1. Likewise, the connecting relationship as shown in FIG. 1 is also comprised in the description about the configuration or function.

It is thus clear that the compensation pixel circuit can be divided into three operating phases in time order, i.e., a resetting phase, a data voltage writing phase and a light emitting phase. The whole operating process is performed sequentially according to the order of the resetting module, the data writing module and the light emitting module. That is, the three modules realize their major functions in sequence in the three operating phases corresponding to the three modules, and the switching module and the data writing module realize their functions simultaneously.

In order to describe the technical solution of the present disclosure more clearly, the technical solution and technical effect of the embodiment of the present disclosure will be introduced below by a 7T1C compensating pixel circuit under an exemplary condition.

Figure 2:
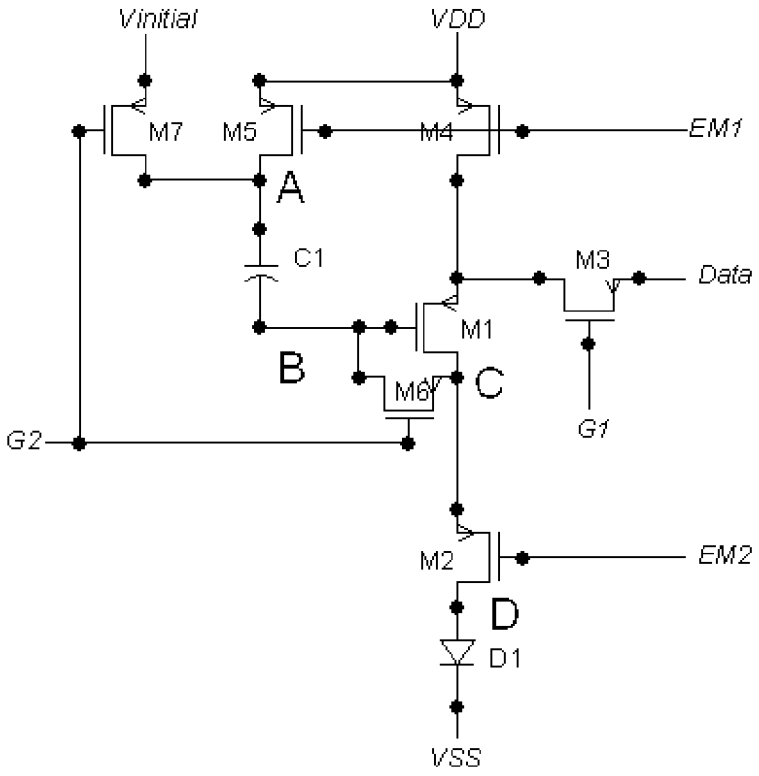
FIG. 2 is schematic diagram of a circuit structure of a 7T1C compensation pixel circuit in an embodiment of the present disclosure.

FIG. 2 schematically shows a circuit structure of a 7T1C compensation pixel circuit in an embodiment of the present disclosure. Referring to FIG. 2, the circuit comprises the organic light emitting diode D1, the driving transistor M1, second to seventh switching elements M2-M7 and the storage capacitor C1.

Except for the capacitor C1, the resetting module further comprises a sixth switching element M6 and a seventh switching element M7. A first terminal and a second terminal of the sixth switching element M6 are connected to the gate and the first terminal of the driving transistor M1 respectively. A second terminal of the seventh switching element M7 is connected to a predetermined voltage Vinitial, and a first terminal thereof is connected to the second terminal of the capacitor C1.

Gates of the sixth switching element M6 and the seventh switching element M7 are connected to a signal line G2. The signal line G2 is configured to control the two switching elements M6 and M7 to be in a turn-on state when the resetting module and the data voltage writing module are operating and to be in a turn-off state when the light emitting control module is operating.

The data voltage writing module comprises a third switching element M3, whose first terminal is connected to the second terminal of the driving transistor M1 and second terminal is connected to a data voltage line VData.

A gate of the third switching element M3 is connected to a signal line G1. The signal line G1 is configured to control the third switching element M3 to be in the turn-on state when the data voltage writing module is operating and to be in the turn-off state when the resetting module and the light emitting control module are operating.

The light emitting control module comprises a fourth switching element M4 and a fifth switching element M5 whose second terminals are connected to an operation voltage line $V_{DD}$ at the high level. A first terminal of the fourth switching element M4 is connected to the second terminal of the driving transistor M1. A first terminal of the fifth switching element M5 is connected to the second terminal of the capacitor C1.

Gates of the fourth switching element M4 and the fifth switching element M5 are connected to a signal line EM1. The signal line EM1 is configured to control the two switching elements M4 and M5 to be in the turn-off state when the resetting module and the data voltage writing module are operating and to be in the turn-on state when the light emitting control module is operating.

The switching module comprises a second switching element M2, whose first terminal is connected to the anode of the organic light emitting diode D1, and second terminal is connected to the first terminal of the driving transistor M1.

Since the switching module is configured to disconnect the driving transistor M1 from the organic light emitting diode D1 when the data voltage VData is supplied to the second terminal of the driving transistor M1, a signal EM2 connected to the control terminal of the second switching element M2 is actually an inverse signal of the signal G1.

Herein, the switching element refers to an element whose first terminal and second terminal are controlled by a signal of the control terminal to be connected or disconnected. Of course, it can be implemented by a variety of specific electrical elements.

It is thus clear that in the basis constitution and connecting relationship of the circuit, as described above, the driving transistor M1 and the organic light emitting diode D1 constitute the basic OLED driving relationship, while the second to seventh switching elements M2-M7 can be controlled to be in the turn-on/turn-off state by the signals of their respective control terminals connected thereto. Of course, zero points of potentials of all the bias voltages are connected to a same common terminal, and zero points of potentials of all the signal voltages are connected to a same common terminal.

Alternatively, the driving transistor and the second to seventh switching elements are thin film transistors TFTs. Herein, the thin film transistors adopted in the present embodiment are P type channel thin film transistors. By corresponding to this situation, the first terminals of the driving transistor and the second to seventh switching elements represent drains, the second terminals thereof represent sources, and the control terminals of the second to seventh switching element represent gates. Of course, other types of transistors can also be used as equivalent substitutes.

Thus, because the compensation pixel circuit comprises seven TFTs and one capacitor, it can be called as a new type 7T1C compensation pixel circuit in a naming manner conventionally used in the art.

Figure 3:
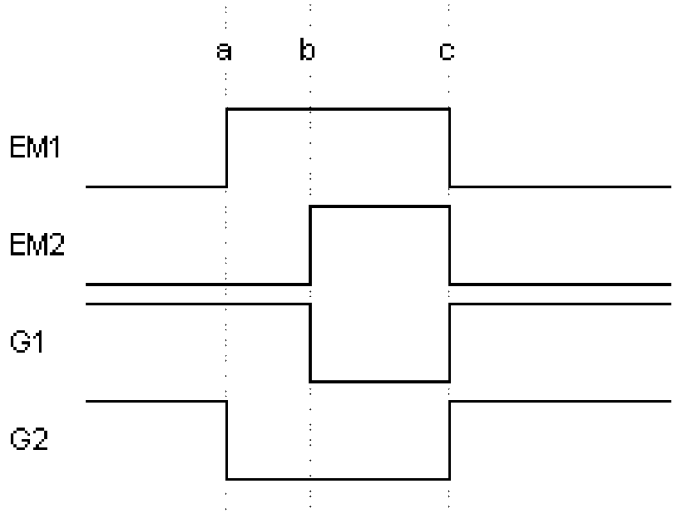
FIG. 3 is an operation timing schematic diagram of a 7T1C compensation pixel circuit in an embodiment of the present disclosure.

FIG. 3 shows schematically an operation timing of the 7T1C compensation pixel circuit in the embodiment of the present disclosure. Based on the 7T1C compensating pixel circuit under the above exemplary condition, the operating principle of the circuit can be described below by referring to FIG. 3.

As shown in FIG. 3, referring to the operation timing diagram of the circuit, the operating process of the circuit can be divided into for example three phases in general, i.e., a resetting phase (a-b), a data writing phase (b-c), and light emitting phase (c-).

Specifically, in the resetting phase, the signal EM1 and the signal G1 are at the high level, so that the transistors M3, M4, M5 are in the turn-off state; whereas the signals EM2 and G2 are at the low level, and the low level of the signal EM2 makes the transistor M2 turned on, and at the same time makes nodes C and D of the source and drain of the transistor M2 turned on and connected. The low level of the signal G2 makes the transistors M6 and M7 turned on, so that the turn-on of the transistor M7 makes the potential at a node A of the storage capacitor C1 is reset as the signal Vinitial. In addition, the turn-on of the transistor M6 makes the gate and drain of driving transistor M1 connected to each other. In this way, the nodes B, C, and D are then connected to each other, and the potential at the node B of the storage capacitor C1 is discharged to a low voltage via the organic light emitting diode D1. This low voltage is the threshold voltage of the organic light emitting diode D1. Of course, the organic light emitting diode D1 is now in the turn-off state and does not emit light.

In the data writing phase, the signal EM2 becomes the high level, so that the transistor M2 is turned off. The signal G2 is maintained at the low level, and at the same time the signal G1 also becomes the low level, so that the transistor M3 is turned on, and the data signal VData is written into the source of the driving transistor M1 via the transistor M3. Now, since the signal G2 is continuously maintained at the low level, the transistor M1 connected to OLED operates in a saturation region, and then the potential at the node B becomes VData+Vth. As the potential at the node A is Vinitial, the potentials at the two terminals of the storage capacitor C1 becomes Vinitial and VData+Vth respectively.

In the light emitting phase, the signals G1 and G2 become the high level, so that the transistors M3, M6 and M7 are turned off. The signals EM1 and EM2 become the low level, so that the transistors M4, M5 and M2 are turned on. After the transistor M5 is turned on, the potential at the node A of the storage capacitor C1 becomes $V_{DD}$ from Vinitial. According to the principle of charge conservation, the potential at the node A becomes $V_{DD}$+VData+Vth−Vinitial. Now, the transistor M1 is in the saturation region. According to the current formula of the saturation region, it can be known that the current outflowing from the transistor M1 is:

$$\begin{aligned} I_{DS} &= \frac{1}{2}K(V_{GS} - Vth)^2 \\ &= \frac{1}{2}K(V_{DD} + Vdata + Vth - Vinitial - V_{DD} - Vth)^2 \\ &= \frac{1}{2}K(Vdata - Vinitial)^2 \end{aligned}$$

where K in the same structure is stable relatively and can be regarded as a constant herein.

Therefore, in the process of light emitting of OLED, the current flowing through the organic light emitting diode D1 connected to the drain of the driving transistor M1 is only related to Vinitial and VData, but is not unrelated to Vth and $V_{DD}$. As Vinitial does not form a current loop, the gate voltage of the driving transistor M1 can be reset to a fixed value each time under the effect of the resetting module, and would not be affected by the IR drop (voltage drop, i.e., the voltage attenuation of the gate signal line described in the background section) phenomenon. As a result, the problem of the current flowing through OLED being non-uniform in magnitude is not caused by the non-uniformity of the threshold voltage Vth due to the manufacturing process of the backplane, that is, the problem of non-uniformity of light emitting is not caused. At the same time, the potential at the node A of the storage capacitor C1 is always the signal $V_{DD}$ in the process of light emitting, and no charge loss occurs, which ensures the stability of the potential at the node A, so that the current flowing through the driving transistor M1 is stable, and thus the organic light emitting diode D1 emits light stably. Of course, the above embodiment is only used to describe the technical solution of the present disclosure, but not to limit the present disclosure. Although the present disclosure is described in detail by referring to the above embodiments, those ordinary skilled in the art shall understand that no matter what kind of structure the resetting module, the data writing module and the light emitting control module and the switching module adopt in a specific implementation process, the present disclosure can be implemented by referring to the operating principle described in the embodiment of the present disclosure only if the resetting module, the data writing module and the light emitting control module and the switching module have the function of the above compensation pixel circuit, which certainly does not depart from the spirit and scope of the technical solutions of the embodiment of the present disclosure.

Second Embodiment

Based on the same inventive concept, an embodiment of the present disclosure further provides a display apparatus comprising any one of the compensation pixel circuits described above. The display apparatus may be any product or component having the function of displaying, such as an OLED panel, a mobile phone, a tablet computer, a television, a display, a notebook computer, and a digital photo frame, and a navigator and the like.

When the circuit is designed to be a pixel unit in the array substrate, since the signal lines G1 and G2 are signals being configured to control the data voltage writing, according to the high level or the low level of the gate driving signal, one of the signals G1 and G2 can be connected to the gate line corresponding to the row while the other thereof is made to be its inverse signal. For the signal lines EM1 and G2, they are configured to reset the gate voltage, and thus the signal lines EM1 and G2 can be implemented by designing corresponding resetting switch signal lines or can be obtained through certain logic circuit operation according to the gate line signal.

The display apparatus provided in the embodiment of the present disclosure can solve the same technical problem and produce the same technical effect because it has the same technical features as any one of the compensation pixel circuits as described above.

To sum up, the configuration of the compensation pixel circuit provided in the embodiments of the present disclosure makes the current that finally drives OLED to emit light is unrelated to the threshold voltage Vth and the bias voltage $V_{DD}$, so that the compensation pixel circuit can not only compensate for the OLED current difference due to the threshold voltage offset but also have the function of compensating for the influence of the signal voltage attenuation on the current. At the same time, the resetting module in the circuit can reset the gate voltage of the driving transistor, i.e., making that the upper frame signal has little impact on the lower frame signal, thereby reducing influence of signals from frame to frame greatly. Therefore, the compensation pixel circuit and the display apparatus provided in the present disclosure have not only the function of compensating for the threshold voltage offset but also the function of resetting the gate voltage of the driving transistor, thereby reducing influence of signals from frame to frame greatly and at the same time ensuring the non-uniformity and stability of the light emitting of OLED.

It should be noted that the relationship terms such as "first" and "second" in the present disclosure are just used to distinct one entity or one operation from another entity or another operation, instead of requiring or suggesting that any actual relationship or order exist among these entities or operations.

The above embodiment are just used to describe the technical solutions of the present disclosure, but not used to limit the present disclosure. Although the present disclosure has been described in detail by referring to the embodiments described above, those ordinary skilled in the art shall understand that they can still modify the technical solutions disclosed in the above respective embodiments or make equivalent replacements of a part of technical features. These modifications or replacements shall not render the substance of the corresponding technical solutions to depart from the spirit and scope of the technical solutions in the respective embodiments of the present disclosure.

The present application claims the priority of a Chinese patent application No. 201410194265.X filed on May 8, 2014. Herein, the content disclosed by the Chinese patent application is incorporated in full by reference as a part of the present disclosure.

What is claimed is:

1. A compensation pixel circuit comprising an organic light emitting diode and a driving transistor, a first terminal of the driving transistor being connected to an anode of the organic light emitting diode, wherein the compensation pixel circuit further comprises:

a resetting module including a capacitor whose first terminal is connected to a gate of the driving transistor and configured to make the gate of the driving transistor discharge so that a gate voltage is reduced to a magnitude of a threshold voltage of the organic light emitting diode;

a data voltage writing module configured to discharge at the gate of the driving transistor so as to connect a data voltage to a second terminal of the driving transistor after the gate voltage is reduced to the magnitude of the threshold voltage of the organic light emitting diode;

a light emitting control module configured to connect a source of the driving transistor and a second terminal of the capacitor to an operating voltage at a high level after data voltage writing is completed; and a switching module configured to disconnect the driving transistor from the organic light emitting diode when the data voltage is connected to the second terminal of the driving transistor;

wherein the first terminal of the driving transistor is connected to the anode of the organic light emitting diode via the switching module, the switching module is further configured to connect the driving transistor to the organic light emitting diode when it is discharged at the gate of the driving transistor, and the first terminal of the driving transistor is a drain, and the second terminal of the driving transistor is the source of the driving transistor.

2. The compensation pixel circuit according to claim 1, wherein the resetting module further comprises a sixth switching element and a seventh switching element, wherein:

a first terminal and a second terminal of the sixth switching element are connected to the gate and the first terminal of the driving transistor respectively; and a second terminal of the seventh switching element is connected to a predetermined voltage, and a first terminal thereof is connected to the second terminal of the capacitor.

3. The compensation pixel circuit according to claim 2, wherein signals connected to control terminals of the sixth switching element and the seventh switching element are configured to control the sixth switching element and the seventh switching element to be in a turn-on state when the resetting module and the data voltage writing module are operating and to be in a turn-off state when the light emitting control module is operating.

4. The compensation pixel circuit according to claim 1, wherein the data voltage writing module comprises a third switching element, whose first terminal is connected to the second terminal of the driving transistor and second terminal is connected to a data voltage line.

5. The compensation pixel circuit according to claim 4, wherein a signal connected to a control terminal of the third switching elements is configured to control the third switching element to be in the turn-on state when the data voltage writing module is operating and to be in the turn-off state when the resetting module and the light emitting control module are operating.

6. The compensation pixel circuit according to claim 1, wherein the light emitting control module comprises a fourth switching element and a fifth switching element, whose second terminals are connected to an operating voltage line at the high level;

a first terminal of the fourth switching element is connected to the second terminal of the driving transistor; and the first terminal of the fifth switching element is connected to the second terminal of the capacitor.

7. The compensation pixel circuit according to claim 6, wherein signals connected to control terminals of the fourth switching element and the fifth switching element are configured to control the fourth switching element and the fifth switching element to be in the turn-off state when the resetting module and the data voltage writing module are operating and to be in the turn-on state when the light emitting control module is operating.

8. The compensation pixel circuit according to claim 1, wherein the switching module comprises a second switching element, whose first terminal is connected to the anode of the organic light emitting diode, and second terminal is connected to the first terminal of the driving transistor.

9. The compensation pixel circuit according to of claim 2, wherein the driving transistor, the second to seventh switching elements are thin film transistors.

10. An display apparatus comprising the compensation pixel circuit according to claim 1.

11. The display apparatus according to claim 10, wherein the resetting module further comprises a sixth switching element and a seventh switching element, wherein:

a first terminal and a second terminal of the sixth switching element are connected to the gate and the first terminal of the driving transistor respectively; and a second terminal of the seventh switching element is connected to a predetermined voltage, and a first terminal thereof is connected to the second terminal of the capacitor.

12. The display apparatus according to claim 11, wherein signals connected to control terminals of the sixth switching element and the seventh switching element are configured to control the sixth switching element and the seventh switching element to be in a turn-on state when the resetting module and the data voltage writing module are operating and to be in a turn-off state when the light emitting control module is operating.

13. The display apparatus according to claim 10, wherein the data voltage writing module comprises a third switching element, whose first terminal is connected to the second terminal of the driving transistor and second terminal is connected to a data voltage line.

14. The display apparatus according to claim 13, wherein a signal connected to a control terminal of the third switching elements is configured to control the third switching element to be in the turn-on state when the data voltage writing module is operating and to be in the turn-off state when the resetting module and the light emitting control module are operating.

15. The display apparatus according to claim 10, wherein the light emitting control module comprises a fourth switching element and a fifth switching element, whose second terminals are connected to an operating voltage line at the high level;

a first terminal of the fourth switching element is connected to the second terminal of the driving transistor; and the first terminal of the fifth switching element is connected to the second terminal of the capacitor.

16. The display apparatus according to claim 15, wherein signals connected to control terminals of the fourth switching element and the fifth switching element are configured to control the fourth switching element and the fifth switching element to be in the turn-off state when the resetting module and the data voltage writing module are operating and to be in the turn-on state when the light emitting control module is operating.

17. The display apparatus according to claim 10, wherein the switching module comprises a second switching element, whose first terminal is connected to the anode of the organic light emitting diode, and second terminal is connected to the first terminal of the driving transistor.

18. The display apparatus according to of claim 11, wherein the driving transistor, the second to seventh switching elements are thin film transistors.

* * * * *